US008858158B2

(12) United States Patent
Ikeda et al.

(10) Patent No.: US 8,858,158 B2
(45) Date of Patent: Oct. 14, 2014

(54) STEAM TURBINE AND STEAM TURBINE PLANT SYSTEM

(75) Inventors: Kazutaka Ikeda, Tokyo (JP); Katsuya Yamashita, Tokyo (JP); Takao Inukai, Kawasaki (JP); Kazuhiro Saito, Yokohama (JP); Kouichi Kitaguchi, Yokohama (JP); Shogo Iwai, Kawasaki (JP); Shigekazu Miyashita, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 950 days.

(21) Appl. No.: 12/536,652

(22) Filed: Aug. 6, 2009

(65) Prior Publication Data

US 2010/0034641 A1 Feb. 11, 2010

(30) Foreign Application Priority Data

Aug. 7, 2008 (JP) ..... 2008-204197

(51) Int. Cl.
*F01D 25/24* (2006.01)
*F01D 25/14* (2006.01)
*F01D 25/26* (2006.01)

(52) U.S. Cl.
CPC ..... *F01D 25/26* (2013.01); *F01D 25/14* (2013.01)
USPC ..... 415/108; 415/176; 415/178; 415/180; 415/214.1; 415/136; 277/609; 277/616; 285/19; 285/20; 285/141.1

(58) Field of Classification Search
USPC ..... 415/108, 99–103, 134–136, 115–117, 415/111–113, 180, 175–178, 214.1; 277/630, 637, 616, 609; 285/19, 20, 285/141.1
See application file for complete search history.

(56) References Cited

U.S. PATENT DOCUMENTS

| | | | | |
|---|---|---|---|---|
| 2,326,112 | A * | 8/1943 | Zetterquist | 415/176 |
| 4,498,301 | A * | 2/1985 | Tsubouchi | 415/175 |
| 5,520,398 | A * | 5/1996 | Brandon | 415/134 |
| 6,010,302 | A | 1/2000 | Oeynhausen | |
| 7,484,926 | B2 | 2/2009 | Suga et al. | |
| 7,850,423 | B2 | 12/2010 | Yamashita | |
| 8,118,551 | B2 | 2/2012 | Ichiryu et al. | |
| 2005/0022529 | A1 * | 2/2005 | Takahashi et al. | 60/653 |
| 2009/0202345 | A1 | 8/2009 | Ichiryu et al. | |

FOREIGN PATENT DOCUMENTS

| | | | |
|---|---|---|---|
| EP | 1 479 873 | A2 | 11/2004 |
| EP | 1 502 966 | A2 | 2/2005 |
| EP | 1 752 614 | A2 | 2/2007 |
| GB | 825849 | A | 12/1959 |
| JP | 52-16701 | U | 1/1987 |
| JP | 05-113104 | A | 5/1993 |

(Continued)

*Primary Examiner* — Christopher Verdier
(74) *Attorney, Agent, or Firm* — Foley & Lardner LLP

(57) ABSTRACT

A steam turbine 10 is comprised of a double-structured casing configured of an outer casing 21 and an inner casing 20, a turbine rotor 23 disposed through the inner casing and having a plurality of stages of moving blades 22 implanted, and a plurality of stages of stationary blades 25 disposed alternately with the moving blades 22 in the axial direction of the turbine rotor 23 in the inner casing 20. The steam turbine 10 is further provided with a discharge passage 30 which externally guides steam, which has flown in the inner casing and passed the final stage moving blades while performing expansion work, directly from the inner casing interior.

6 Claims, 6 Drawing Sheets

(56) References Cited

FOREIGN PATENT DOCUMENTS

| | | | |
|---|---|---|---|
| JP | 07-145707 | A | 6/1995 |
| JP | 07-158408 | A | 6/1995 |
| JP | 09-280008 | A | 10/1997 |
| JP | 2000-502775 | | 3/2000 |
| JP | 2006-046088 | A | 2/2006 |
| JP | 2006-097544 | A | 4/2006 |
| JP | 2006-307280 | A | 11/2006 |
| JP | 2007-218119 | A | 8/2007 |
| JP | 2007-291966 | A | 11/2007 |

* cited by examiner

STEAM TURBINE AND STEAM TURBINE PLANT SYSTEM

CROSS-REFERENCE TO RELATED APPLICATIONS

This application is based upon and claims the benefit of priority from the prior Japanese Patent Application No. 2008-204197, filed on Aug. 7, 2008; the entire contents of which are incorporated herein by reference.

BACKGROUND OF THE INVENTION

1. Field of the Invention

The present invention relates to a steam turbine provided with a double-structured casing of an outer casing and an inner casing and to a steam turbine plant system provided with the steam turbine.

2. Description of the Related Art

A steam turbine having a high pressure occasionally has a casing structure having a double structure of an outer casing and an inner casing as described in, for example, JP-A 2006-307280 (KOKAI). In such a structure, exhaust steam at first stage moving blades flows between the inner casing and the outer casing via a gland portion and meets the turbine exhaust steam. Therefore, the outer casing has a design pressure which is a differential pressure between a pressure between the inner and outer casings and an external pressure of the outer casing. And, the casing structure is also influenced by the temperature of steam flowing between the inner and outer casings.

In the above-described steam turbine having the conventional double-structured casing, if the conditions of steam as a working fluid include a supercritical pressure or an ultra supercritical pressure, it is necessary to use a material having high strength for the outer casing or to increase the thickness of the outer casing. Therefore, the steam turbine had a problem that its production cost became high.

BRIEF SUMMARY OF THE INVENTION

The present invention provides a steam turbine that an outer casing in a double-structured casing configured of the outer casing and an inner casing can be designed regardless of conditions of exhaust steam and its production cost can be suppressed, and a steam turbine plant system provided with the steam turbine.

According to an aspect of the present invention, there is provided a steam turbine, comprising a double-structured casing configured of an outer casing and an inner casing; a turbine rotor which is disposed through the inner casing and has a plurality of stages of moving blades implanted; a plurality of stages of stationary blades disposed alternately with the moving blades in an axial direction of the turbine rotor in the inner casing; and a discharge passage which guides a working fluid, which has flown in the inner casing and passed the final stage moving blades, directly from the inner casing interior to an outside of the outer casing.

According to another aspect of the present invention, there is provided a steam turbine plant system including a plurality of steam turbines, at least one of the plurality of steam turbines comprising a double-structured casing configured of an outer casing and an inner casing; a turbine rotor which is disposed through the inner casing and has a plurality of stages of moving blades implanted; a plurality of stages of stationary blades disposed alternately with the moving blades in an axial direction of the turbine rotor in the inner casing; a discharge passage that guides a working fluid, which has flown in the inner casing and passed the final stage moving blades, directly from the inner casing interior to an outside of the outer casing; a cooling working fluid supply pipe that supplies a cooling working fluid to a space between the outer casing and the inner casing; and a cooling working fluid discharge pipe that discharges the cooling working fluid used for cooling from the space, wherein the cooling working fluid discharged from the cooling working fluid discharge pipe is introduced to another steam turbine and/or a heat exchanger, which utilize the cooling working fluid as a heat source for heating feed water.

BRIEF DESCRIPTION OF THE DRAWINGS

The present invention is described with reference to the drawings, which are provided for illustration only and do not limit the present invention in any respect.

DETAILED DESCRIPTION OF THE INVENTION

Embodiments according to the present invention will be described with reference to the drawings.

First Embodiment

Figure 1A:
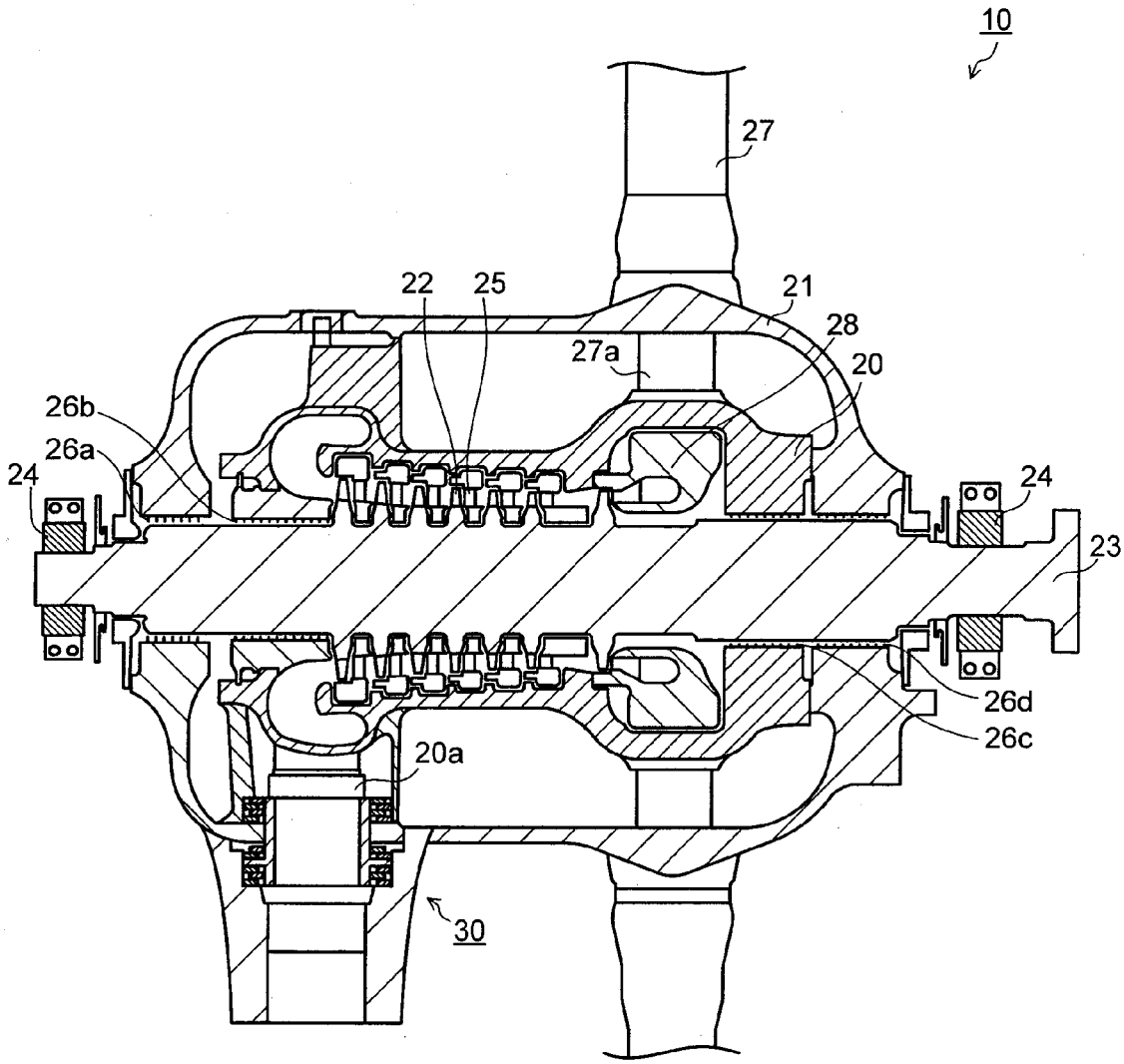
FIG. 1A is a diagram showing a cross section of the steam turbine according to a first embodiment.
Figure 1B:
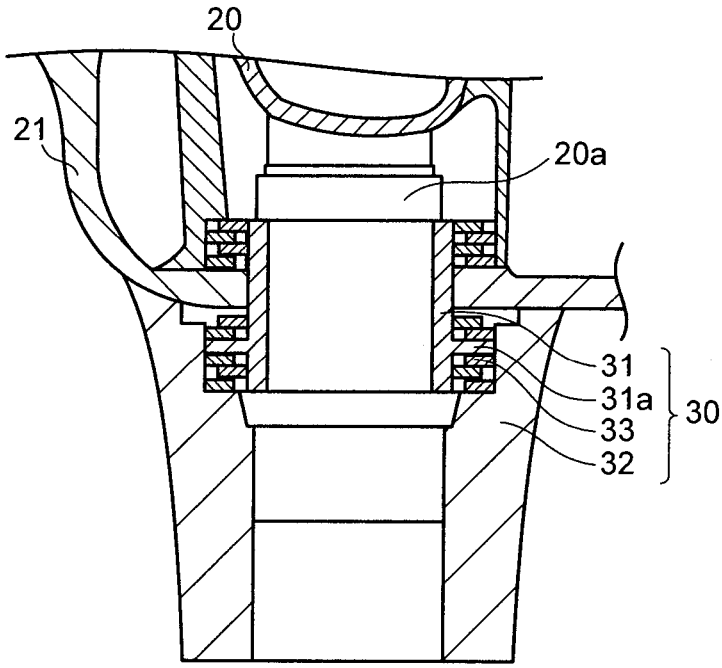
FIG. 1B is a diagram showing a cross section of a discharge passage in a magnified form.

FIG. 1A is a diagram showing a cross section of a steam turbine 10 according to the first embodiment. FIG. 1B is a diagram showing a cross section of a discharge passage 30 in a magnified form.

As shown in FIG. 1A, the steam turbine 10 is provided with a double-structured casing of an inner casing 20 and an outer casing 21 which is disposed outside of the inner casing 20. And, a turbine rotor 23 in which moving blades 22 are implanted is disposed through the inner casing 20. The turbine rotor 23 is rotatably supported by rotor bearings 24.

Stationary blades 25 are disposed on the inner surface of the inner casing 20 in the axial direction of the turbine rotor 23 so as to be arranged alternately with the moving blades 22. Gland labyrinth portions 26*a*, 26*b*, 26*c*, 26*d* are disposed between the turbine rotor 23 and the individual casings to prevent the steam as the working fluid from leaking outside. The steam turbine 10 is provided with a main steam pipe 27, through which main steam is introduced into the steam turbine 10. The main steam introduced into the main steam pipe 27 is guided to an inlet sleeve 27*a* which is inserted into the inner diameter side of the main steam pipe 27 through unshown plural seal rings. The inlet sleeve 27*a* is connected to communicate with a nozzle box 28 through which the steam is guided toward the moving blades 22, and the main steam is guided to the nozzle box 28 through the inlet sleeve 27*a*.

The steam turbine 10 is also provided with the discharge passage 30 which directly guides the steam as the working fluid, which has flown through the steam passage in the inner casing 20 while performing expansion work and passed the final stage moving blades 22, from the inside of the inner casing 20 to the outside of the outer casing 21 (i.e. the steam turbine 10). In other words, an end of the side where the steam having passed the final stage moving blades 22 flows out, namely the downstream end of the steam passage within the inner casing 20, has a shape which is closed excepting a connection portion 20*a* to the discharge passage 30. Therefore, it is configured such that the downstream side of the steam passage in the inner casing 20 is not communicated with a space between the inner casing 20 and the outer casing 21. And, one end of the discharge passage 30 is communicated with the connection portion 20*a* which is disposed at the downstream end of the steam passage within the inner casing 20. Thus, except for a minute amount of steam passing the gland labyrinth portion 26*b*, substantially the total amount of the steam having passed the final stage moving blades 22 within the inner casing 20 flows through the discharge passage 30 and is discharged to the outside of the outer casing 21, namely the outside of the steam turbine 10.

For example, the discharge passage 30 may be configured of a single pipe with its one end connected to communicate with the steam passage at the downstream end of the steam passage of the inner casing 20. The discharge passage 30 is preferably provided with a sleeve structure as shown in FIG. 1B.

Specifically, the discharge passage 30 is provided with an exhaust sleeve 31 whose one end is fitted into the inner diameter side of the connection portion 20*a* through plural seal rings 33 which are disposed at the downstream end of the steam passage of the inner casing 20. The discharge passage 30 also has a structure that the other end of the exhaust sleeve 31 is also fitted into the inner diameter side of an exhaust steam pipe 32 which is disposed on the outer casing 21 through plural seal rings 33. Here, a flange 31*a* is disposed in the circumferential direction on the outer circumference portion of the exhaust sleeve 31. The flange 31*a* is fitted between the plural seal rings 33 to have its vertical position fixed at a portion where it is fitted into the exhaust steam pipe 32. The plural seal rings 33 comprise one which is fitted into the inner circumference of the exhaust steam pipe 32 or the connection portion 20*a* at the downstream end of the steam passage of the inner casing and the other which is fitted to the outer circumference of the exhaust sleeve 31. And, these seal rings 33 are disposed in a form alternately stacked in the axial direction of the exhaust sleeve 31.

By configuring as described above, the discharged high temperature and pressure steam is prevented from flowing into the space between the inner casing 20 and the outer casing 21. For example, even if the inner casing 20 or the outer casing 21 is deformed in the axial direction of the discharge passage 30, the steam having passed the moving blades 22 can be prevented from leaking into the space between the inner casing 20 and the outer casing 21 because both ends of the exhaust sleeve 31 are configured to fit to the inner casing 20 and the exhaust steam pipe 32 through the plural seal rings 33. According to this embodiment, the seal rings 33 are configured by alternately stacking them which are fitted to the inner circumference and the outer circumference in the axial direction of the exhaust sleeve 31, so that the seal rings can securely seal the steam at their position. When the discharge passage 30 is formed to have a sleeve structure as in this embodiment, the exhaust steam pipe 32 from the outer casing 21 can be integrally formed with the outer casing 21 without configuring as a pipe connected to the outer casing. In this case, productivity can be improved by forming the exhaust steam pipe integrally with the outer casing by casting or the like.

Steam flow in the steam turbine 10 is described below.

The steam flown into the nozzle box 28 within the steam turbine 10 through the main steam pipe 27 rotates the turbine rotor 23 by flowing through the steam passage between the stationary blades 25 disposed on the inner casing 20 and the moving blades 22 implanted in the turbine rotor 23. The steam which has passed the final stage moving blades 22 by flowing within the inner casing 20 while performing the expansion work flows through the exhaust sleeve 31 communicated with the inner casing 20 and then the exhaust steam pipe 32 which is connected to the downstream end of the exhaust sleeve 31, and is discharged to the outside of the steam turbine 10.

As described above, the steam turbine 10 of the first embodiment closes the end of the steam passage of the inner casing 20 on the side, where the steam having passed the final stage moving blades 22 flows out, at a portion other than the connection portion, so that the steam having passed the final stage moving blades 22 can be exhausted from the inner casing 20 through the discharge passage 30. Thus, the exhausted high temperature and pressure steam is prevented from flowing into the space between the inner casing 20 and the outer casing 21. Therefore, the outer casing 21 can be designed regardless of the conditions of the steam to be exhausted. For example, the material, thickness and the like of the outer casing 21 are not required to correspond with the conditions of the high temperature and pressure steam, and the steam turbine production cost can be suppressed.

When the discharge passage 30 is formed to have a sleeve structure, the exhaust steam can be prevented from leaking to the space between the inner casing 20 and the outer casing 21.

Second Embodiment

Figure 2:
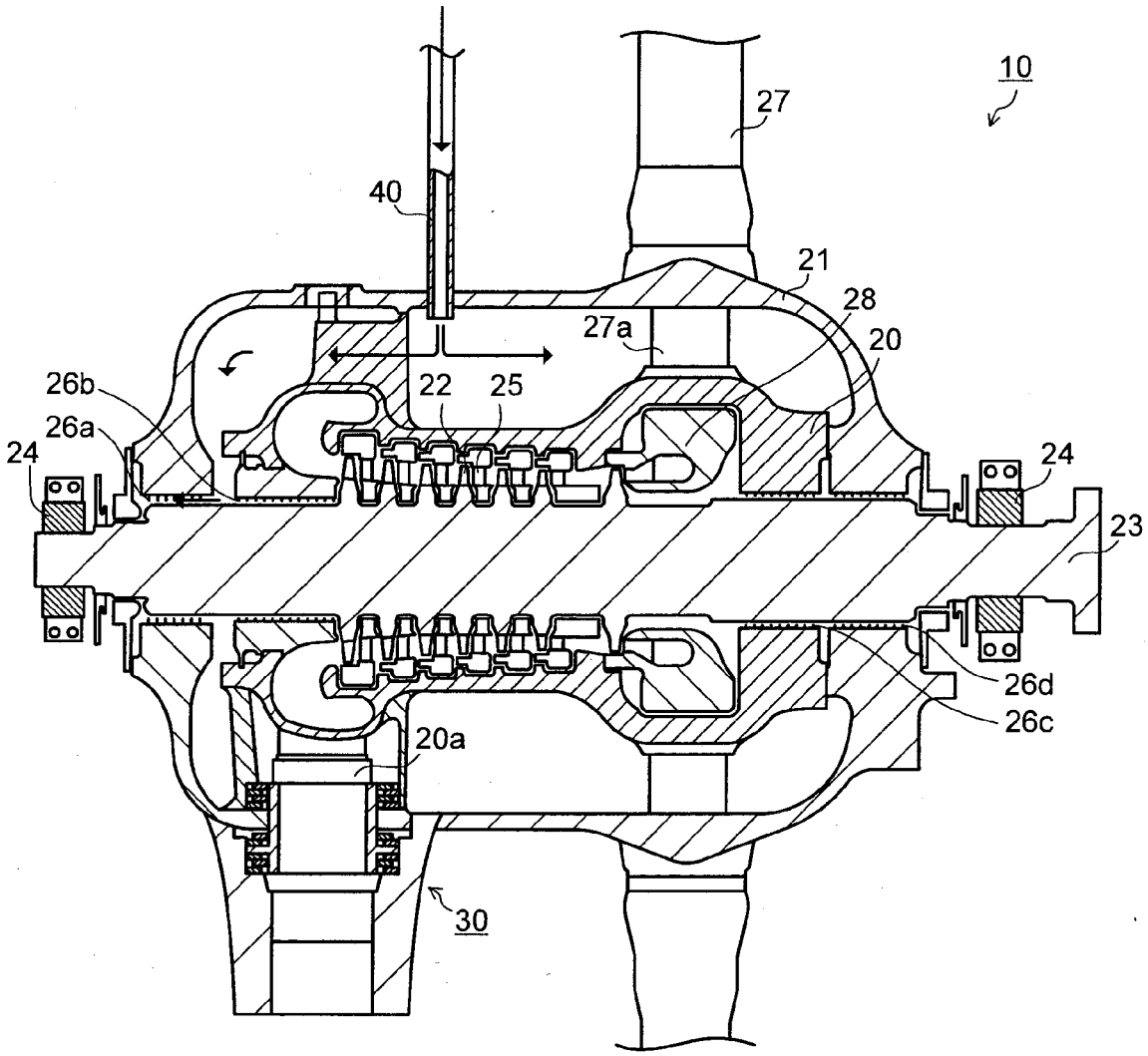
FIG. 2 is a diagram showing a cross section of a steam turbine according to a second embodiment.

FIG. 2 is a diagram showing a cross section of the steam turbine 10 according to the second embodiment. Like component parts corresponding to those of the steam turbine 10 of the first embodiment are denoted by like reference numerals, and overlapped descriptions will be omitted or simplified.

As shown in FIG. 2, the steam turbine 10 of the second embodiment has a structure that the steam turbine 10 of the first embodiment is provided with a cooling working fluid supply pipe for supplying a cooling working fluid to the space between the outer casing 21 and the inner casing 20. Therefore, the cooling working fluid supply pipe is mainly described below.

The cooling working fluid supply pipe may be configured to have a structure such that the cooling working fluid is supplied to the space between the outer casing 21 and the inner casing 20. An example of the cooling working fluid supply pipe may be constructed in a pipe 40, being communicated with the space between the outer casing 21 and the inner casing 20. The pipe 40 is provided within at least a portion of the outer casing 21 as shown in FIG. 2, and the cooling working fluid is introduced to the space via the pipe 40. As the cooling working fluid, for example, steam from the boiler or steam extracted from another steam turbine can be used. The cooling working fluid must be supplied at a temperature at which the steam functions as the cooling medium. Therefore, the source of supplying the above-described cooling working fluid is appropriately selected depending on the operation conditions of the steam turbine 10.

The flow of the cooling working fluid supplied to between the outer casing 21 and the inner casing 20 is described below.

The cooling working fluid which is supplied to between the outer casing 21 and the inner casing 20 through the pipe 40, as indicated by an arrow in FIG. 2, spreads between the outer casing 21 and the inner casing 20 to cool them. And, the cooling working fluid flows toward the outside along the gland labyrinth portion 26*a* disposed at a downstream side between the outer casing 21 and the turbine rotor 23.

According to the steam turbine 10 of the second embodiment, as well as the first embodiment described above, the end of the inner casing 20 on the flow out side of the steam, which has passed the final stage moving blades 22, is closed except for the discharge passage 30. Thus, the steam having passed the final stage moving blades 22 can be discharged from the inner casing 20 directly to the outside of the outer casing 21 through the discharge passage 30. The discharged high temperature and pressure steam is prevented from flowing to the space between the inner casing 20 and the outer casing 21. Therefore, the outer casing 21 can be designed regardless of the conditions of the steam to be discharged. For example, the material, thickness and the like of the outer casing 21 are not required to correspond with the conditions of the high temperature and pressure steam, and the steam turbine production cost can be suppressed.

In addition, the steam turbine 10 of the second embodiment can be supplied with the cooling working fluid to the space between the outer casing 21 and the inner casing 20 to cool them. Especially, a thermal stress generated in the outer casing 21 can be reduced by cooling the outer casing 21. An effect of cooling the turbine rotor 23 and the gland labyrinth portion 26*a* can also be obtained by the cooling working fluid which flows along the gland labyrinth portion 26*a* disposed between the outer casing 21 and the turbine rotor 23. Especially, cooling the turbine rotor 23 and the gland labyrinth portion 26*a* may be effective to suppress them from, for example, being deformed thermally in the steam turbine, which operates under high temperature and pressure conditions, such as an ultra supercritical pressure turbine.

Figure 3:
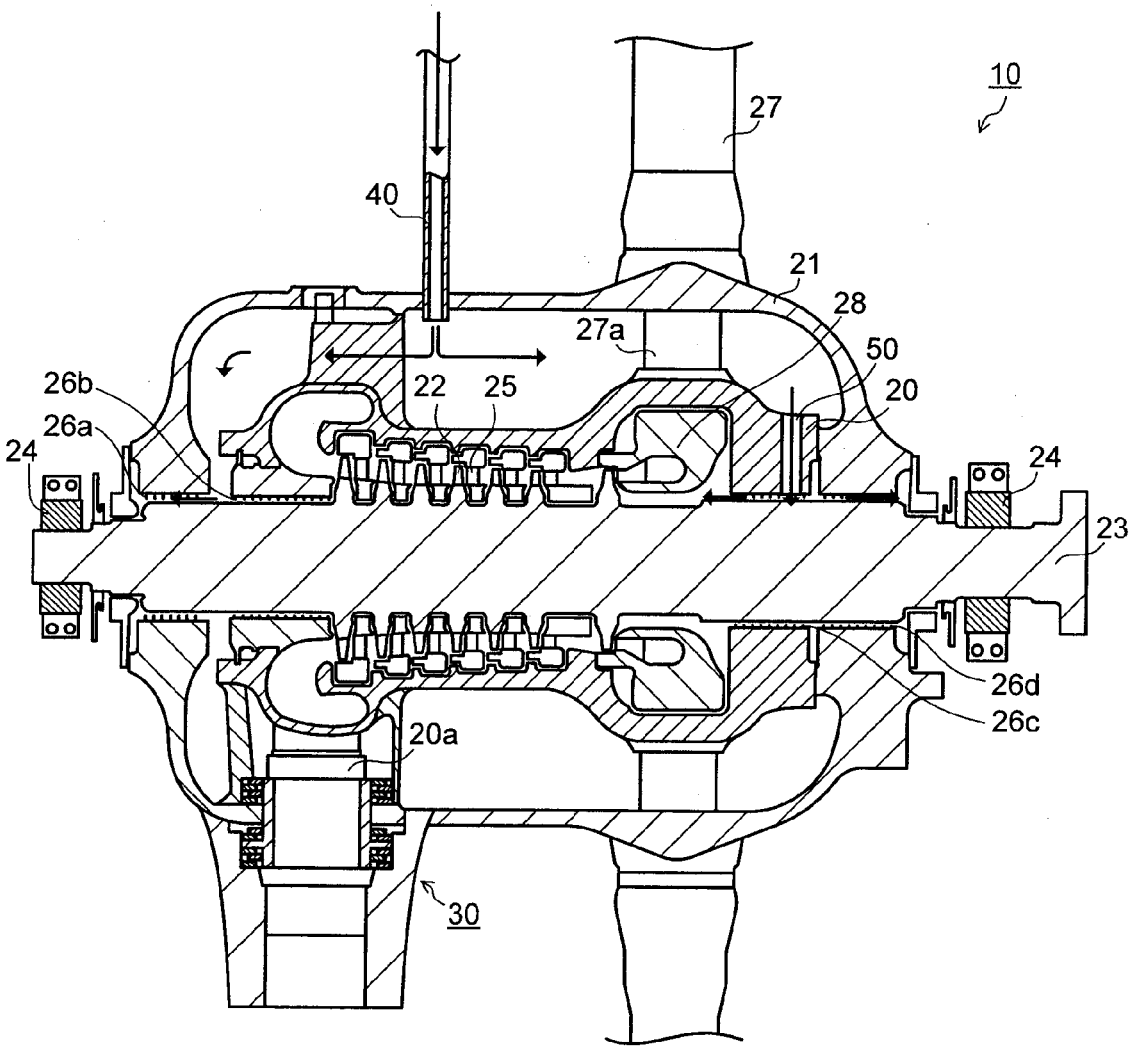
FIG. 3 is a diagram showing a cross section of a different steam turbine according to the second embodiment.

The structure of the steam turbine 10 of the second embodiment is not limited to the above-described structure. FIG. 3 is a diagram showing a cross section of a different steam turbine 10 according to the second embodiment.

As shown in FIG. 3, the different steam turbine 10 of the second embodiment has a through port 50 which is formed in the inner casing 20 in order to guide partially the cooling working fluid supplied to between the outer casing 21 and the inner casing 20 to the surface of the turbine rotor 23. The through port 50 is formed to guide the cooling working fluid to the surface of the turbine rotor 23 at a position on the other side of the moving blades with the nozzle box 28 located between them. In other words, it is formed to guide the cooling working fluid to the surface of the turbine rotor 23 positioned at the right side of the position where the nozzle box 28 is disposed in FIG. 3. Specifically, the through port 50 can be formed to communicate with the gland labyrinth portion 26*c* which is disposed on the upstream side between the inner casing 20 and the turbine rotor 23. The through port 50 may also be formed at plural locations in the circumferential direction of the inner casing 20.

The flow of the cooling working fluid supplied to between the outer casing 21 and the inner casing 20 is described below.

The cooling working fluid which is supplied to between the outer casing 21 and the inner casing 20 through the pipe 40 as indicated by the arrow in FIG. 2 spreads between the outer casing 21 and the inner casing 20 to cool them. And, the cooling working fluid flows toward the outside along the gland labyrinth portion 26*a* disposed on the downstream side between the outer casing 21 and the turbine rotor 23.

And, a part of the cooling working fluid is introduced to the surface of the turbine rotor 23 through the through port 50. The cooling working fluid guided to the surface of the turbine rotor 23 flows along the surface of the turbine rotor 23 to the nozzle box 28 side and a side different from the nozzle box 28 side as indicated by arrows in FIG. 3. The cooling working fluid, which has flown to the side different from the nozzle box 28 side, flows toward the outside along the gland labyrinth portion 26*d*. In other words, the cooling working fluid flown toward the gland labyrinth portion 26*d* disposed on the upstream side between the outer casing 21 and the turbine rotor 23 flows toward the outside along the gland labyrinth portion 26*d*.

Thus, the through port 50 is formed in the inner casing 20 to guide a part of the cooling working fluid to the surface of the turbine rotor 23, so that the turbine rotor 23 and the gland labyrinth portions 26*c*, 26*d* can be cooled. Especially, cooling the turbine rotor 23 and the gland labyrinth portions 26*c*, 26*d* may be effective to suppress them from, for example, being deformed thermally in the steam turbine, which operates under high temperature and pressure conditions, such as an ultra supercritical pressure turbine.

Here, to provide the structure shown in FIG. 3, it is preferable to recover the cooling working fluid flowing toward the outside along the gland labyrinth portions 26*a*, 26*d*, disposed between the outer casing 21 and the turbine rotor 23, and thermal energy of the cooling working fluid flown from the gland labyrinth portions 26*a*, 26*d* can be utilized effectively.

Figure 4:
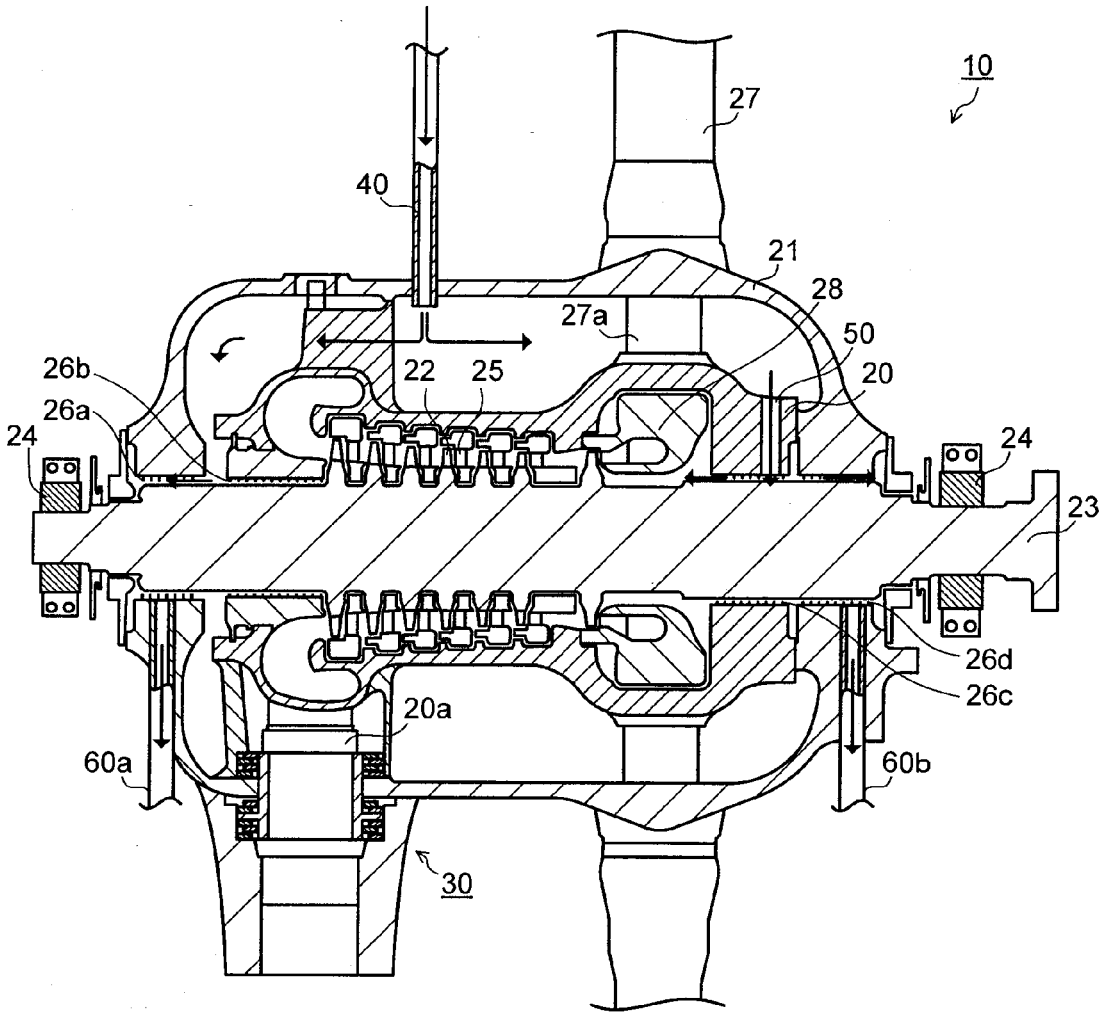
FIG. 4 is a diagram of another different steam turbine of the second embodiment showing a cross section of a structure having cooling working fluid discharge pipes for recovering a cooling working fluid and discharging it to the outside.
Figure 5:
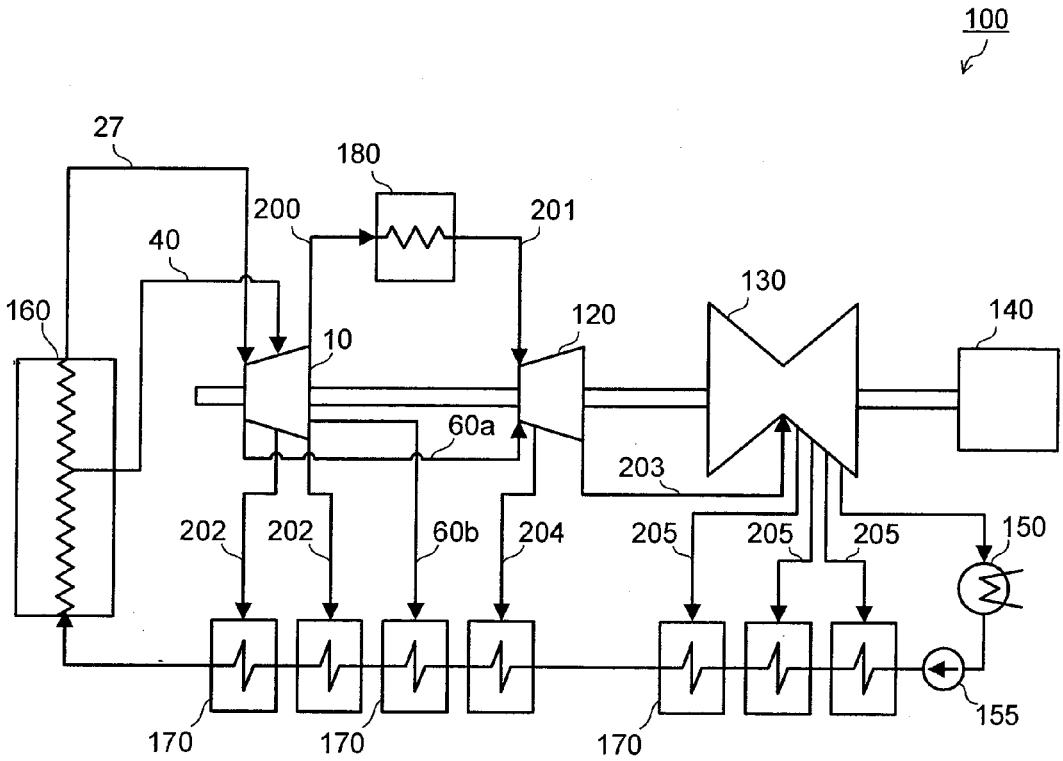
FIG. 5 is a diagram schematically showing an outline of a steam turbine plant system provided with the steam turbine shown in FIG. 4.

FIG. 4 is a diagram showing a cross section of a structure of another example of the steam turbine 10 according to the second embodiment, further having cooling working fluid discharge pipes for recovering and discharging the cooling working fluid for utilization in the different steam turbine 10. FIG. 5 is a diagram schematically showing an outline of a steam turbine plant system 100 provided with the steam turbine 10 shown in FIG. 4.

The gland labyrinth portions 26*a*, 26*d* disposed between the outer casing 21 and the turbine rotor 23 in the steam turbine 10 shown in FIG. 4 are provided with the cooling working fluid discharge pipes for discharging upon recovering the cooling working fluid flowing toward the outside of the steam turbine 10 along the gland labyrinth portions 26*a*, 26*d*.

These cooling working fluid discharge pipes are configured by having through ports formed in the outer casing 21 to communicate with, for example, relatively outside portions (at the left side of the gland labyrinth portion 26*a* and the right side of the gland labyrinth portion 26*d* in FIG. 4) of the gland labyrinth portions 26*a*, 26*d*, and connecting pipes 60*a*, 60*b* to the through ports so as to guide the cooling working fluid outside of the outer casing 21 (i.e. outside of the steam turbine 10). According to example, the pipes 60*a*, 60*b* are disposed at relatively outside portions of the gland labyrinth portions 26*a*, 26*d* to enable to improve an effect of cooling the gland labyrinth portions 26*a*, 26*d* and the turbine rotor 23. The cooling working fluid flowing toward the outside along the gland labyrinth portions 26*a*, 26*d* is recovered through the pipes 60*a*, 60*b* and discharged to the outside.

An example of the steam turbine plant system which effectively uses thermal energy possessed by the cooling working fluid which is discharged out of the steam turbine 10 through the pipes 60*a*, 60*b* is described below with reference to FIG. 5.

The steam turbine plant system 100 shown in FIG. 5 mainly comprises the steam turbine 10 of the invention which functions as a high-pressure turbine, an intermediate-pressure turbine 120, a low-pressure turbine 130, an electric generator 140, a condenser 150, a boiler 160, heat exchangers 170, and a reheater 180.

The flow of steam as the working fluid in the steam turbine plant system 100 is described below.

The steam which is heated to a predetermined temperature by the boiler 160 and flown out of the boiler 160 flows into the steam turbine 10, as a high-pressure turbine, through the main steam pipe 27. And, the steam having a predetermined temperature extracted from the boiler 160 is supplied as a cooling working fluid to the space between the outer casing 21 and the inner casing 20 of the steam turbine 10 through the pipe 40 as described above.

The steam which has flown into the steam turbine 10, performed expansion work and passed the final stage moving blades 22 is discharged directly from the inner casing 20 to an outside of the outer casing 21 through the discharge passage 30 as described above. The steam discharged from the steam turbine 10 is guided to the reheater 180 through a low-temperature reheating pipe 200, heated to a predetermined temperature and guided to the intermediate-pressure turbine 120 through a high-temperature reheating pipe 201. The steam extracted from the steam turbine 10 (i.e. the high pressure turbine) and a part of the discharged steam from the steam turbine 10 are supplied to the heat exchanger 170 through a steam extraction pipe 202 and used as a medium (i.e. a heat source) for heating the condensate (i.e. feed water) from the condenser 150. The cooling working fluid, which is recovered into the pipe 60*a* from the gland labyrinth portion 26*a* and discharged to the outside, namely the cooling steam, is guided to be utilized in the intermediate-pressure turbine 120. And, the cooling working fluid which is recovered into the pipe 60*b* from the gland labyrinth portion 26*b* and discharged to the outside, namely the cooling steam, is supplied to the heat exchanger 170 and utilized as a medium for heating the condensate from the condenser 150.

The steam flown into the intermediate-pressure turbine 120 performs expansion work therein and is discharged and supplied into the low-pressure turbine 130 through a crossover pipe 203. The steam extracted from the intermediate-pressure turbine 120 is supplied to the heat exchanger 170 through a steam extraction pipe 204 and used as a medium for heating the condensate from the condenser 150.

The steam supplied to the low-pressure turbine 130 performs expansion work and is turned into a condensate by the condenser 150. And, the steam extracted from the low-pressure turbine 130 is supplied to the heat exchanger 170 through a steam extraction pipe 205 and used as a medium for heating the condensate from the condenser 150.

The condensate in the condenser 150 is heated by the heat exchanger 170 with a pressure increased by a boiler feed pump 155 and returned to the boiler 160 as feed water. The condensate (i.e. feed water) returned to the boiler 160 is heated again to become high temperature steam having a predetermined temperature, and it is supplied to the steam turbine 10, as the high-pressure turbine, through the main steam pipe 27. The electric generator 140 is driven to rotate by the expansion work of the individual steam turbines to generate electric power.

The above-described steam turbine plant system 100 can utilize thermal energy of the cooling working fluid used as a cooling medium as the heat source the feed water (i.e. condensate) from the condenser 150, so that the heat efficiency of the system can be improved. The cooling working fluid used as the cooling medium can also be introduced into the steam turbine at a downstream side. Thus, the heat efficiency of the system can also be improved.

The structure of the steam turbine plant system is not limited to the above-described one but adequate if it has a structure that the thermal energy possessed by the cooling working fluid used as the cooling medium is used to improve the heat efficiency of the system.

Although the invention has been described above by reference to the embodiments of the invention, the invention is not limited to the embodiments described above. It is to be understood that modifications and variations of the embodiments can be made without departing from the spirit and scope of the invention. For example, the steam turbine 10 according to the invention can be applied to a turbine, to which high temperature and pressure steam is supplied, such as an extra-high pressure turbine, an intermediate-pressure turbine and the like other than the high-pressure turbine.

What is claimed is:

1. A steam turbine, comprising:

a double-structured casing configured of an outer casing and an inner casing, the inner casing being disposed inside of the outer casing, the inner casing forming a steam passage;

a turbine rotor disposed through the inner casing, the turbine rotor having a plurality of stages of moving blades implanted;

a plurality of stages of stationary blades disposed alternately with the moving blades in an axial direction of the turbine rotor in the inner casing;

an exhaust steam pipe disposed at the outer casing;

an exhaust sleeve having a first end fitted in a downstream end of the inner casing and a second end fitted in an inner diameter side of the exhaust steam pipe, the exhaust sleeve being configured to guide a working fluid passed through a final stage of the moving blades from the inner casing to the exhaust steam pipe;

a first sealing ring having an inner circumference in contact with an outer circumference of the exhaust sleeve; and a second sealing ring having an outer circumference in contact with an inner circumference of the downstream end of the inner casing or an inner circumference of the exhaust steam pipe, the second sealing ring and the first sealing ring being disposed in a form alternately stacked in an axial direction of the exhaust sleeve, wherein the second end of the exhaust sleeve has a flange in a circumferential direction on the outer circumference thereof, and wherein the flange is fitted between the first sealing ring and the second sealing ring so as to fix a vertical position of the exhaust sleeve.

2. The steam turbine according to claim 1, further comprising a cooling working fluid supply pipe configured to supply a cooling working fluid to a space between the outer casing and the inner casing.

3. The steam turbine according to claim 2, further comprising a cooling working fluid discharge pipe configured to discharge the cooling working fluid used for cooling from the space.

4. The steam turbine according to claim 2, wherein the inner casing is provided with a through port configured to introduce the cooling working fluid to a surface of the turbine rotor.

5. The steam turbine according to claim 4, further comprising a cooling working fluid discharge pipe configured to discharge the cooling working fluid used for cooling from the space.

6. A steam turbine plant system including a plurality of steam turbines, at least one of the plurality of steam turbines comprising:

a double-structured casing configured of an outer casing and an inner casing, the inner casing being disposed inside of the outer casing, the inner casing forming a steam passage;

a turbine rotor disposed through the inner casing, the turbine rotor having a plurality of stages of moving blades implanted;

a plurality of stages of stationary blades disposed alternately with the moving blades in an axial direction of the turbine rotor in the inner casing;

an exhaust steam pipe disposed at the outer casing;

an exhaust sleeve having a first end fitted in a downstream end of the inner casing and a second end fitted in an inner diameter side of the exhaust steam pipe, the exhaust sleeve being configured to guide a working fluid passed through a final stage of the moving blades from the inner casing to the exhaust steam pipe;

a first sealing ring having an inner circumference in contact with an outer circumference of the exhaust sleeve;

a second sealing ring having an outer circumference in contact with an inner circumference of the downstream end of the inner casing or an inner circumference of the exhaust steam pipe, the second sealing ring and the first sealing ring being disposed in a form alternately stacked in an axial direction of the exhaust sleeve;

a cooling working fluid supply pipe configured to supply a cooling working fluid to a space between the outer casing and the inner casing; and a cooling working fluid discharge pipe configured to discharge the cooling working fluid used for cooling from the space so as to supply the cooling working fluid discharged from the cooling working fluid discharge pipe to another steam turbine and/or a heat exchanger, which utilize the cooling working fluid as a heat source for heating feed water, wherein the second end of the exhaust sleeve has a flange in a circumferential direction on the outer circumference thereof, and wherein the flange is fitted between the first sealing ring and the second sealing ring so as to fix a vertical position of the exhaust sleeve.

* * * * *